US006471818B1

(12) United States Patent
Rapparini

(10) Patent No.: US 6,471,818 B1
(45) Date of Patent: Oct. 29, 2002

(54) PROCEDURE TO FIX A CLOSED ZIPPER-STRIPE INSIDE A FLEXIBLE CONTAINER DURING ITS PACKAGING

(75) Inventor: Gino Rapparini, Bologna (IT)

(73) Assignee: ICA S.p.A., Bologna (IT)

( * ) Notice: Subject to any disclaimer, the term of this patent is extended or adjusted under 35 U.S.C. 154(b) by 0 days.

(21) Appl. No.: 09/485,484

(22) PCT Filed: Oct. 5, 1998

(86) PCT No.: PCT/IB98/01539

§ 371 (c)(1),
(2), (4) Date: Feb. 9, 2000

(87) PCT Pub. No.: WO99/20529

PCT Pub. Date: Apr. 29, 1999

(30) Foreign Application Priority Data

Oct. 17, 1997 (IT) ..... BO97A0623

(51) Int. Cl.[7] ..... B65B 9/02

(52) U.S. Cl. ..... 156/265; 156/292; 156/299; 156/300; 156/301; 156/302; 156/519; 53/451; 206/810; 493/195; 493/200; 493/267

(58) Field of Search ..... 156/265, 519, 156/292, 301, 302, 300, 299; 53/451; 206/810; 493/267, 195, 200

(56) References Cited

U.S. PATENT DOCUMENTS

| | | | | |
|---|---|---|---|---|
| 4,756,629 A | 7/1988 | Tilman et al. | ..... | 383/63 |
| 4,876,842 A | 10/1989 | Ausnit | ..... | 53/410 |
| 5,024,537 A | 6/1991 | Tilman | ..... | 383/63 |
| 5,766,399 A | 6/1998 | Clark | ..... | 156/244.12 |

FOREIGN PATENT DOCUMENTS

| | | |
|---|---|---|
| EP | 0 223 125 | 5/1987 |
| EP | 0 276 554 | 8/1988 |
| EP | 0 302 144 | 2/1989 |
| EP | 0 319 995 | 6/1989 |
| EP | 0 339 324 | 11/1989 |
| EP | 0 371 402 | 6/1990 |
| EP | 0 423 456 | 4/1991 |
| EP | 0 528 721 | 2/1993 |
| EP | 0 667 288 | 8/1995 |
| JP | 01176547 | 12/1989 |
| WO | WO 91/17086 | 11/1991 |

*Primary Examiner*—Linda Gray
(74) *Attorney, Agent, or Firm*—Brown, Martin, Haller & McClain, LLP

(57) ABSTRACT

A process for applying a portion of a closed zipper inside a container of flexible material, in which a segment or portion of a closed zipper-strip is first applied by a fixing device upon the inner sides of a film of flexible material, prior to cutting of the zipper strip portion from the remainder of the zipper strip. The zipper portion is applied in such a position that it will not interfere with the subsequent sealing along transverse seal lines defining the opposite sides of the container.

5 Claims, 8 Drawing Sheets

PROCEDURE TO FIX A CLOSED ZIPPER-STRIPE INSIDE A FLEXIBLE CONTAINER DURING ITS PACKAGING

BACKGROUND OF THE INVENTION

The present invention concerns the packaging technology of flexible containers, particularly those provided with a zipper-stripe working as the opening and closing device for the packages.

A number of related patents have been issued in this particular field, including European Patent Nos. 0223125, 0276554, 0302144, 0319995,0339324, 0423456, 0528721, International Application No. WO 91/17086, and U.S. Pat. Nos. 4,756,629, 4,876,842, and 5,024,537.

From the evaluation of the patent literature listed above, one will gather the problems of transversal sealing of containers inside which a zipper-stripe is attached. In fact, the zipper-stripe causes problems for proper performance of the sealing operation upon transverse sealing of the package.

European Patent No. 0667228 illustrates a machine that copes with the mentioned problem by cutting a small stripe of the closed zipper before sealing it onto the inside walls of the container in the packaging process. The former procedure, however, does not ensure that the portion of zipper is applied to the inner sides of the container in such a position that it will not interfere with the side sealing zones that work as flanks for the container. This invention also employs a device that adjusts and verifies the position of the zipper portion as related to the subsequent transversal sealings. Furthermore, the zipper portion, after being cut in a continuous stripe, is abandoned and advances only by adhering to the inner sides of the flexible material film.

SUMMARY OF THE INVENTION

It is an object of the present invention to provide a new and improved method for ensuring exact positioning of a zipper-stripe in a container during manufacture so as to not have it interfere with the transverse sealing zones that will eventually provide the flanks of the completed containers.

According to the present invention, a method of applying a portion of a closed zipper inside a container of flexible material during manufacture of the container is provided, which comprises the steps of:

applying a length of a closed zipper to the inner side of a film of flexible material with a fixing device in such a position that it will not interfere with transverse sealing zones of a container to be formed from the flexible material; and cutting the zipper to a portion of length less than the inner width of the container after the the zipper has been applied to the inner side of the film with the fixing device.

This method solves the problem of the prior art procedures in a simple and reliable fashion, since a zipper-stripe or portion is applied to the inner side of the film of flexible material before being cut into portions of smaller length than the inner width of the container, thus avoiding the risk of the zipper extending into the transverse sealing zones and making positioning of the zipper easier, since it is not cut until it has been applied and secured to the container.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 6:
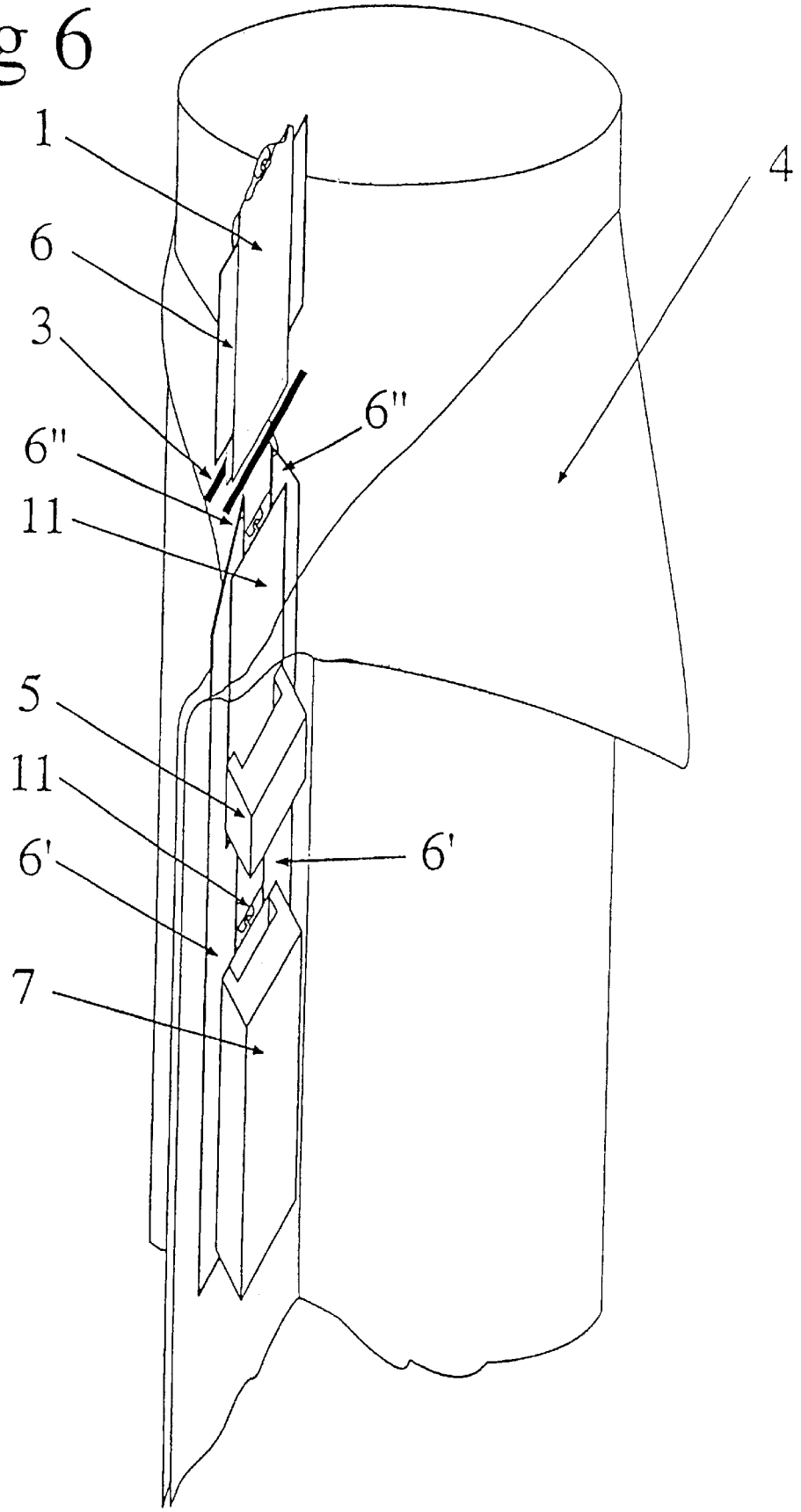
FIG. 6 is a perspective view of the step illustrated in FIG. 3, illustrating the guide mechanism for the zipper feed.
Figure 7:
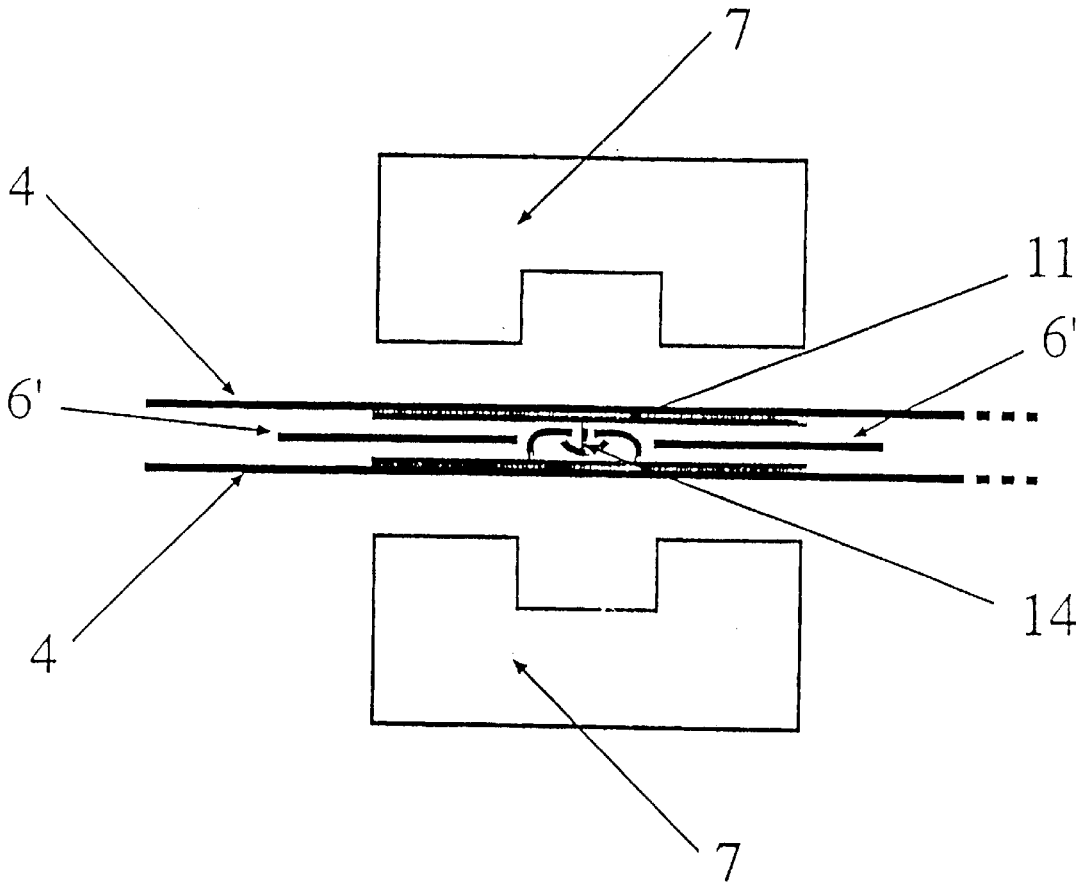
FIG. 7 is a sectional view on the lines 7—7 of FIG. 4.
Figure 8:
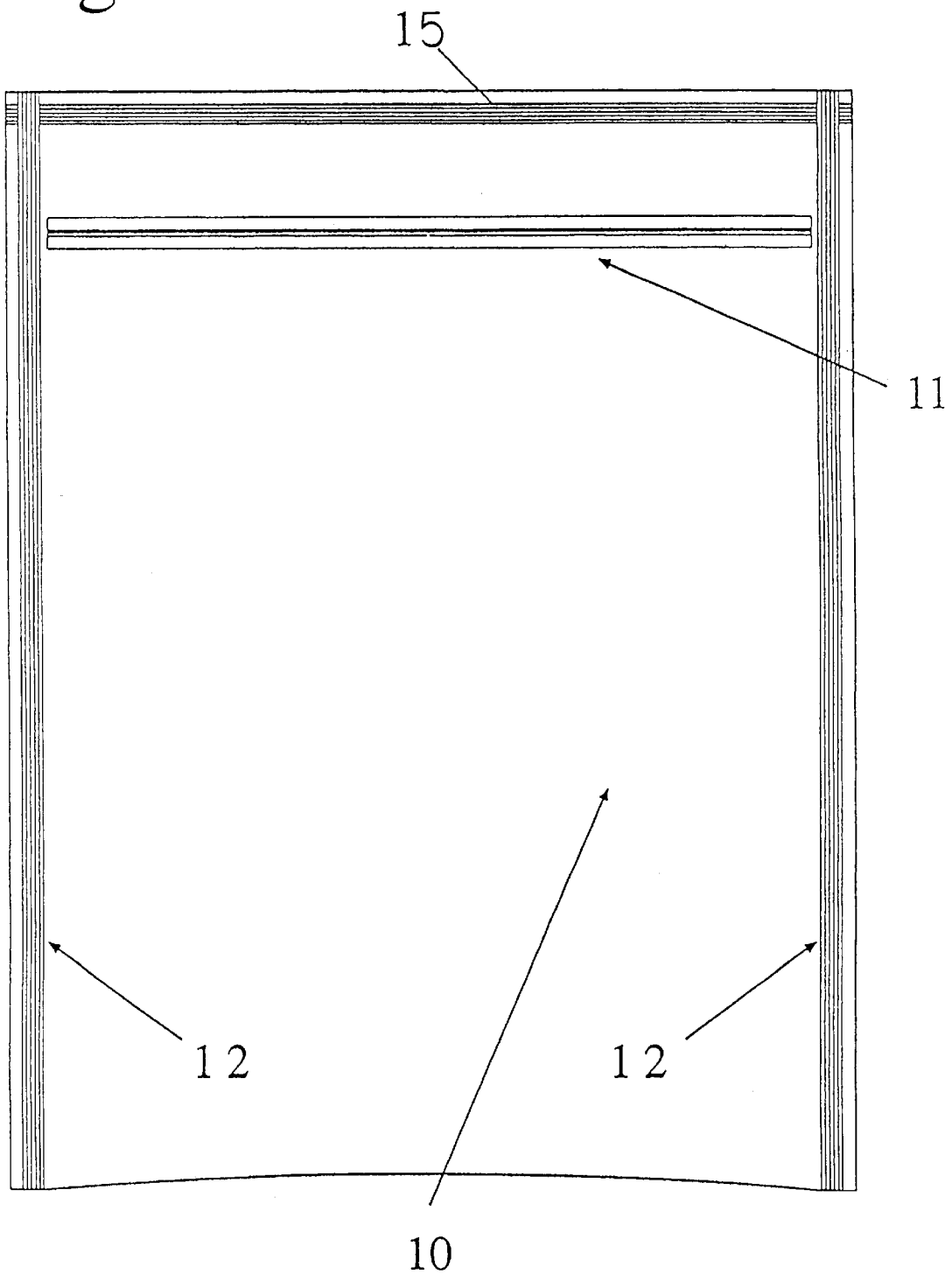
FIG. 8 is a front view of a completed container.

FIGS. 1 to 7 illustrate a method or process for applying a zipper stripe to the inner surface of a flexible film as it is formed into a container according to an exemplary embodiment of the present invention, while FIG. 8 illustrates a completed container.

The apparatus for carrying out the method basically comprises a roller supply of zipper tape 1 carrying a closed zipper 11 which extends through a feeding device 2 and a cutting device 3 into an assembly for forming film 4 of flexible material supplied from a roll into a container. The container forming assembly basically comprises a fixing device 5 for initial fixing of a portion or stripe of the zipper onto film 4, a device 7 for completing the fixing of the zipper-stripe onto a length of film 4, a film transport device 8, a longitudinal sealing device 13, and a transverse sealing device 9. The apparatus also includes sliding guides 6 for the zipper tape upstream of the cutting device 3, and sliding guides 6' with outlines 6" (see FIG. 6) downstream of the cutting device 3 for guiding the zipper-stripe after the tape is cut. The outlines or edges 6" of the sliding guides are of arrow-like shape with the tips of the arrow outlines located at a central joint zone between the two parts of the closed zipper, facilitating insertion of the zipper along guides 6'.

Figure 1:
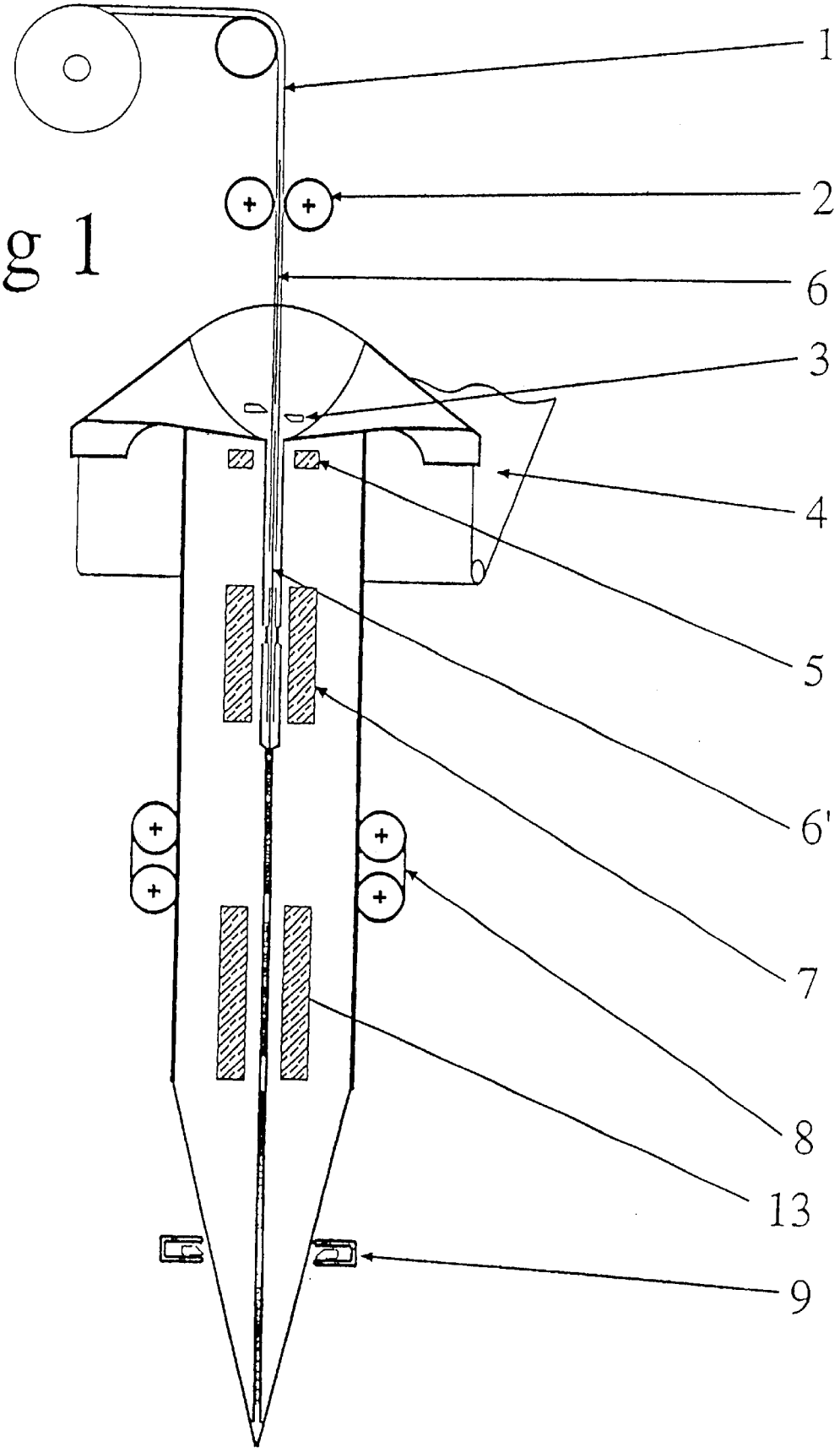
FIG. 1 is a schematic side elevational view of an apparatus for applying zipper-stripes to inner surface of a flexible film during manufacture of a series of containers to be closed by zipper-stripes, illustrating a first step in a process for applying the zipper-stripe according to an exemplary embodiment of the invention.

FIG. 1 illustrates a first step in the process prior to initial fixing of the zipper stripe. In this step, all the operative devices 3,5,7,9, and 13 are open and the feeding devices 2,8 of the zipper tape and film 4 are stationary.

Figure 2:
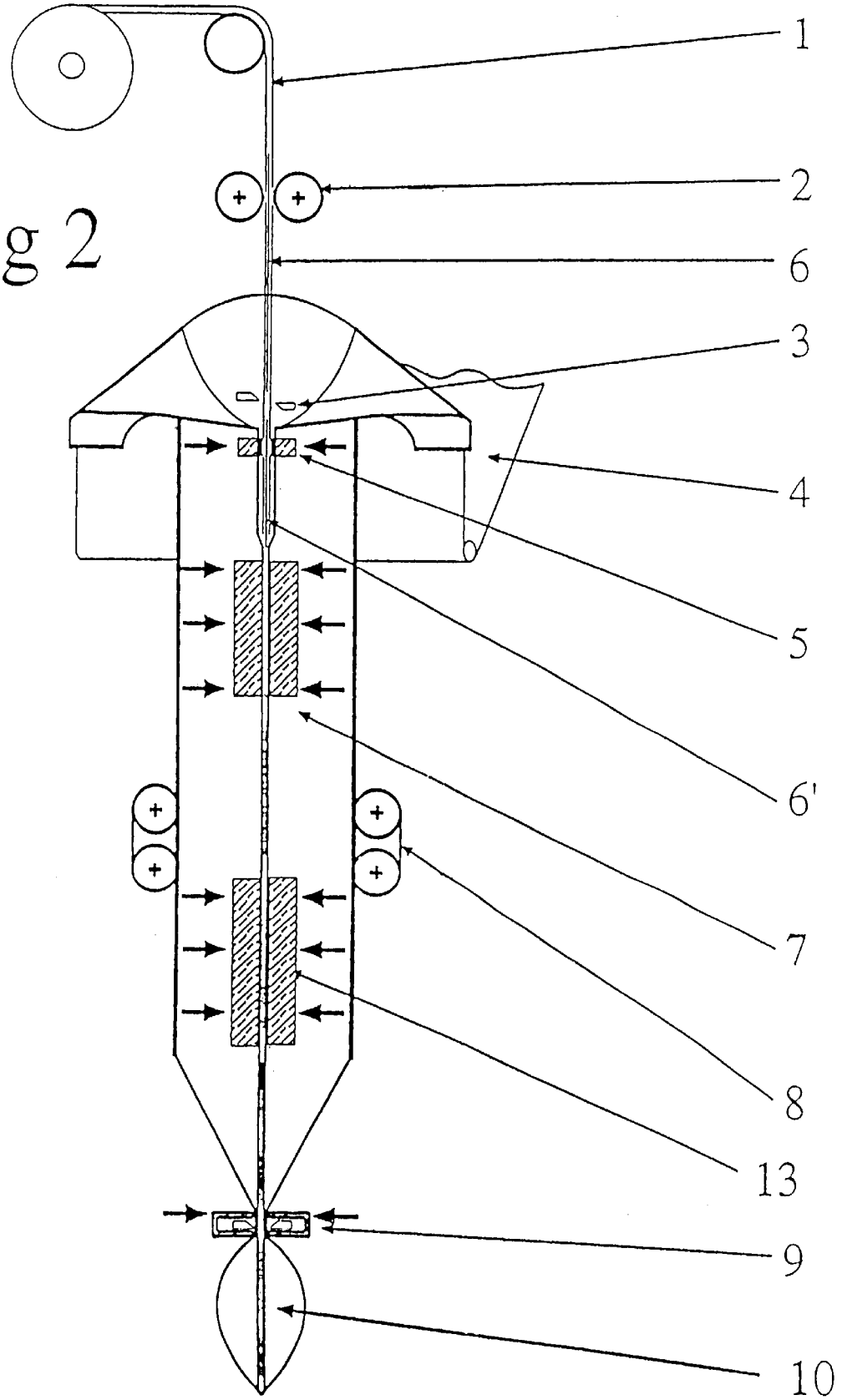
FIG. 2 is a view similar to FIG. 1, illustrating a subsequent step in the process in which a zipper-stripe is fixed to the inner wall of the film.

FIG. 2 illustrates the next step in the process, in which the fixing device 5 is actuated in order to initially fix the zipper-stripe onto the opposing inner walls of the tape 4 of flexible material, before the tape is cut by the cutting device 3. Device 7 that completes the fixing of the zipper-stripe or portion is also shown actuated in this Figure.

Figure 3:
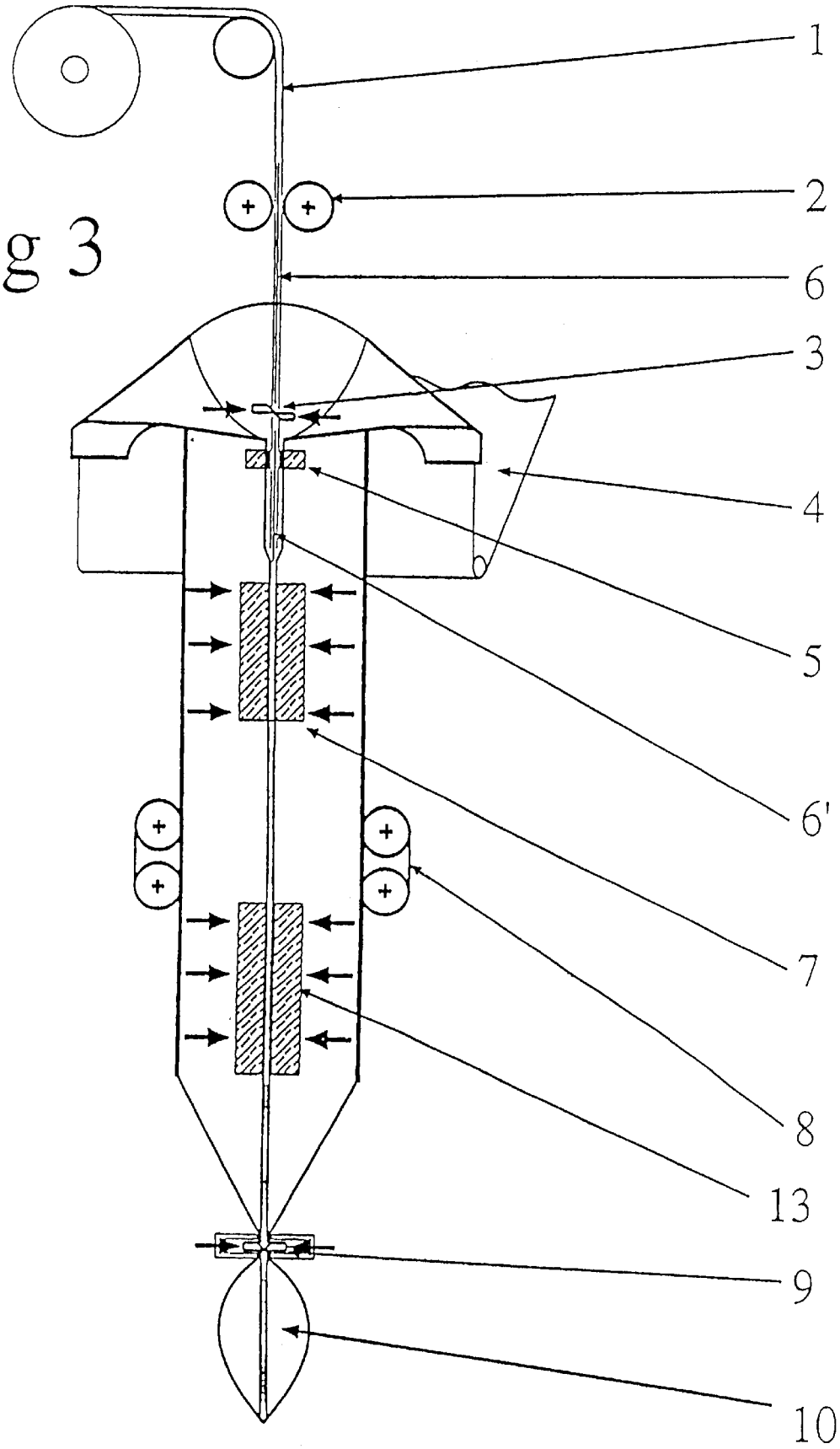
FIG. 3 is a view similar to FIGS. 1 and 2, illustrating the next step in the process, in which the zipper-stripe is cut.

FIG. 3 illustrates the step of actuating the cutting device 3 to cut the fixed portion of zipper from the zipper tape 1. Also illustrated in FIGS. 2 and 3 is the operation of the longitudinal and transverse sealing devices 13 and 9 which perform the longitudinal sealing and the transverse sealing and cut of an individual container. In each of the steps illustrated in FIGS. 1 to 3, the transport devices 2 and 8 for the zipper tape and flexible film are both stationary, and the film and zipper tape do not move during the zipper fixing, cutting, and container sealing steps.

Figure 4:
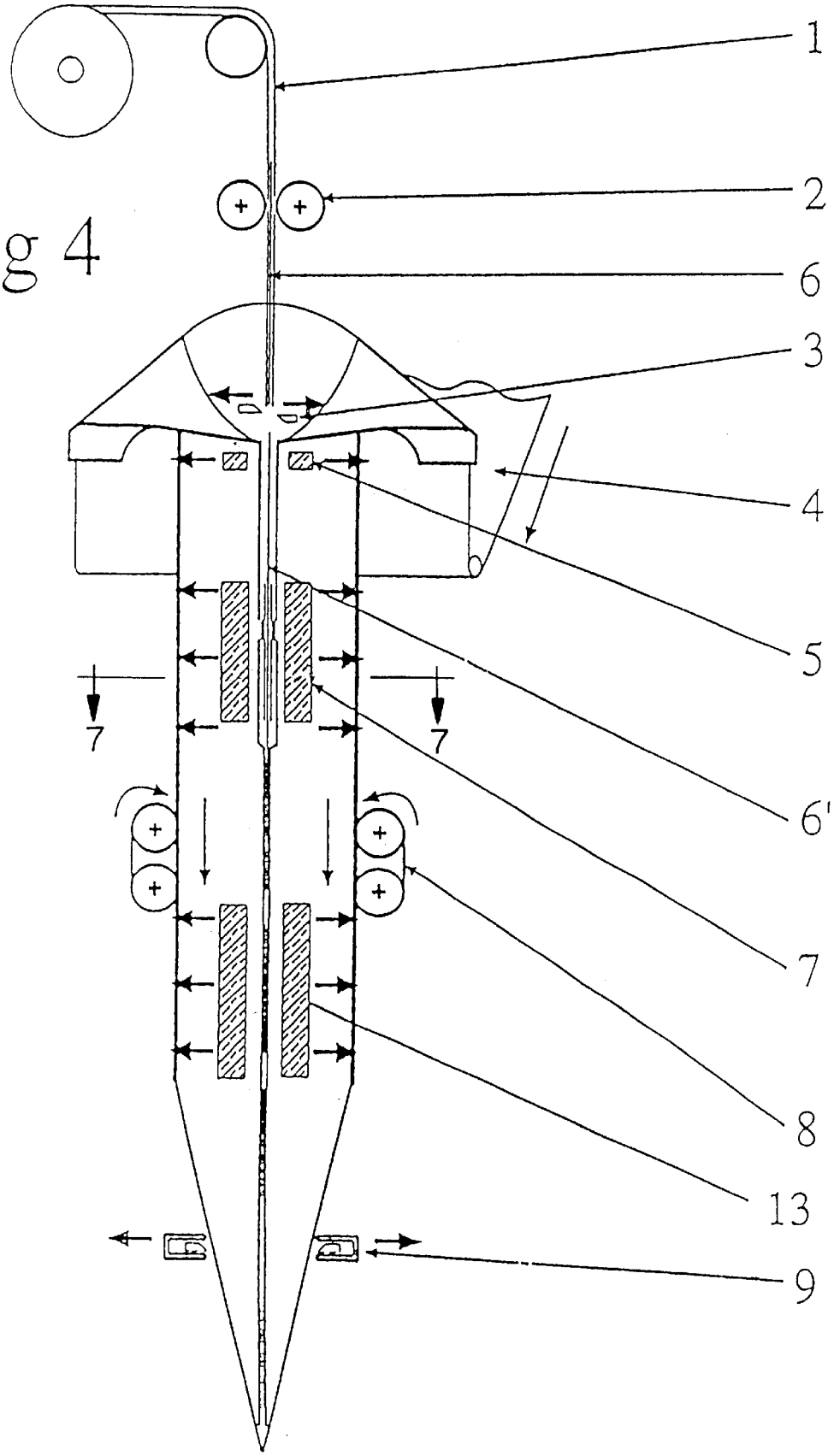
FIG. 4 illustrates a subsequent step in the process in which the next section of film is forwarded into the apparatus.
Figure 5:
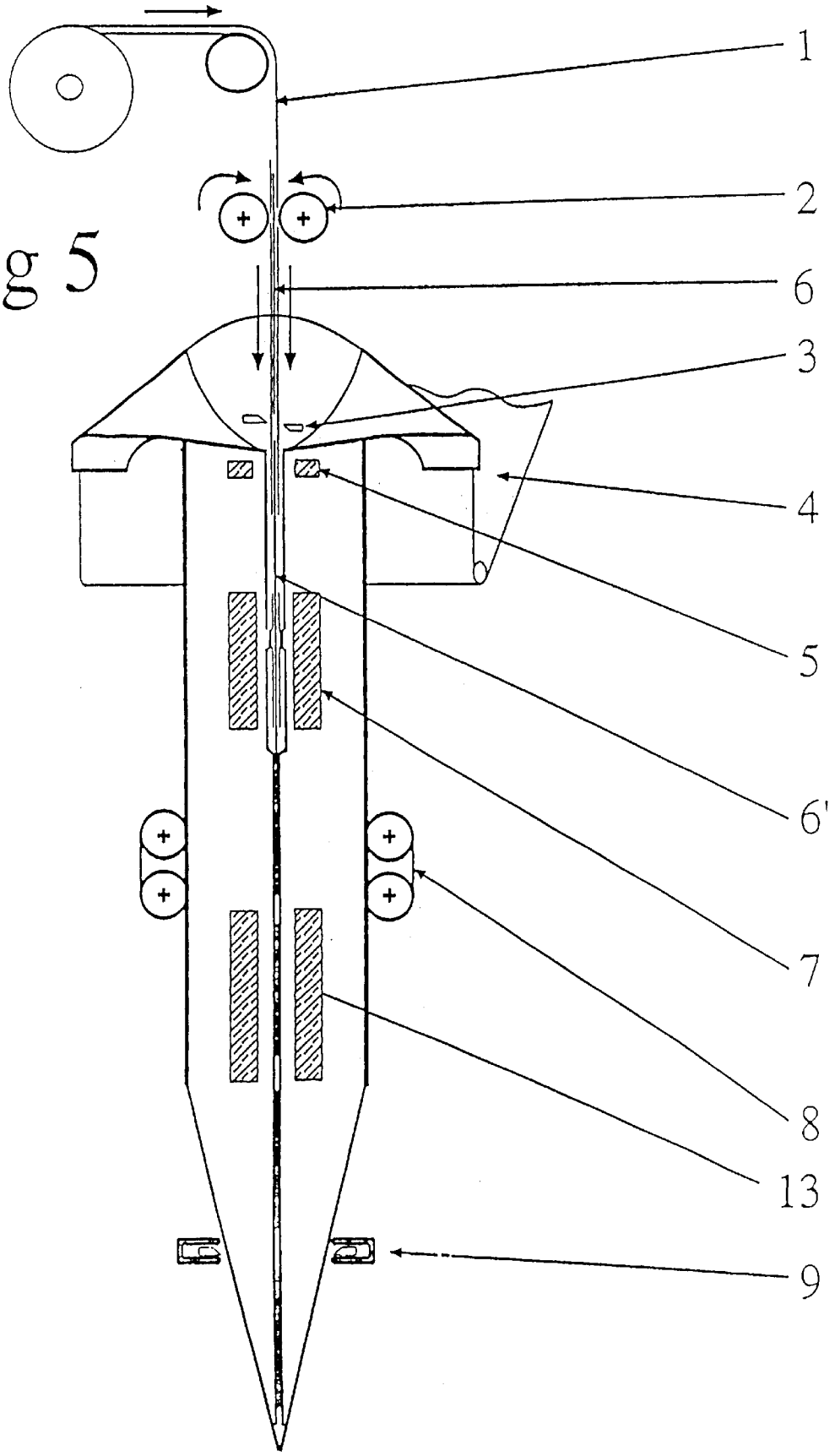
FIG. 5 illustrates the step of feeding the next portion of zipper-stripe into position against the film.

FIG. 4 illustrates a subsequent step in the process. In this step, the devices 3,5,7,9 and 13 are all opened, and the transport device 8 forwards the next section of film 4 for forming into a container, with the zipper tape transport device 2 still being inoperative. In FIG. 5, the next portion of zipper tape 1 is forwarded by transport device 2 into position adjacent the inner faces of the previously transported film, with the film transport device 8 being inoperative at this point. Thus, the feeding of zipper tape 1 is completely independent of the feeding of film 4, and their operation can occur in different steps or phases of the process.

FIG. 6 illustrates the step of FIG. 3 in more detail. This figure illustrates the sliding of the closed zipper on special guides 6 and 6', with guide 6 located upstream of the cutting device 3 and guide 6' located downstream of the cutting device. Guide 6' extends along the entire length of the fixing devices 5 and 7, so as to allow proper fixing of the cut zipper portion or stripe on both inner walls 4 of the container (see FIG. 7).

As best illustrated in FIG. 7, guides 6' are located on opposite sides of the central joint zone 14 between the two parts of the zipper 11, and between the two zipper parts. This allows the two parts of the zipper 11 to be fixed or sealed onto the opposite portions of the film 4 by device 7, without sealing together the two separate parts which make up the zipper.

FIG. 8 is a front view of a completed container 10. The zipper portion or stripe 11 is fixed inside the container before the transverse sealing of opposite sides of the container to form transverse seal lines 12. This ensures that the edges of the zipper stripe do not interfere with the transverse sealing zones. Also illustrated in FIG. 8 is the longitudinal seal line 15 of the container, formed by seal device 13 as indicated in FIG. 3.

In all of the figures, a film of transparent flexible material is illustrated, in order to better highlight the working procedure.

The process of this invention is simple, practical, and reliable, as clearly illustrated in the drawings. The process may be varied in order to produce containers of different sizes and to use different technological components. The process may be used upon a vertically oriented apparatus, or on an apparatus with different structural architecture.

Although an exemplary embodiment of the invention has been described above by way of example only, it will be understood by those skilled in the field that modifications may be made to the disclosed embodiment without departing from the scope of the invention, which is defined by the appended claims.

I claim:

1. A process for applying a portion of a closed zipper inside a container of flexible material as it is being manufactured, comprising the steps of:

feeding a closed zipper between opposing inner faces of flexible film material as the film material is being formed into a container having opposite transverse sealing zones on opposite sides of the container, the zipper extending in a direction transverse to the sides of the container;

securing a length of the zipper to the inner faces of the flexible material in such a position that it does not interfere with the transverse sealing zones of the container; and after the zipper is secured to the inner face of the container, cutting the zipper into a portion of length less than the inner width of the container.

2. The process as claimed in claim 1, including the step of adjusting the length of the cut portion of zipper according to the inner width of the container, whereby containers of different widths can be manufactured.

3. The process as claimed in claim 1, wherein the step of feeding the length of zipper comprises feeding a zipper comprising two zipper parts secured together in a closed condition at a central joint zone between the two zipper parts, and the step of securing the length of zipper portion comprises securing the two zipper parts to the respective opposite inner faces of the container with the zipper remaining in the closed condition during the entire procedure.

4. The apparatus as claimed in claim 3, including the step of guiding the zipper on first and second positioning guides upstream and downstream of a cutting device for cutting the zipper into portions of predetermined length, the step of securing the zipper parts to the opposing inner faces of the film forming the container further comprising locating the second positioning guides between the inner faces of the film on opposite sides of the central joint zone of the zipper and between the two parts of the zipper, whereby sealing of the two parts of the zipper together during fixing of the zipper parts to the film is prevented.

5. The process as claimed in claim 4, including the step of guiding the zipper's cut edges after cutting of a preceding length of zipper which has been secured to the inner faces of a container, whereby a subsequent length of zipper is fed into position for applying to the inner faces of film material for forming the next container, by feeding the cut edges over shaped ends of the second positioning guides, the shaped ends being of arrow-like outline with tips located at the central joint zone between the two closed zipper parts.

* * * * *